US008585485B2

(12) United States Patent
Guinn

(10) Patent No.: US 8,585,485 B2
(45) Date of Patent: Nov. 19, 2013

(54) COMMUNITY GAME USING OPTIMAL OUTCOME FROM INDIVIDUAL PORTION IN SUBSEQUENT COMMUNITY PORTION

(75) Inventor: Andrew C. Guinn, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 13/410,144

(22) Filed: Mar. 1, 2012

(65) Prior Publication Data

US 2012/0231868 A1 Sep. 13, 2012

Related U.S. Application Data

(60) Provisional application No. 61/451,538, filed on Mar. 10, 2011.

(51) Int. Cl.
*A63F 9/24* (2006.01)

(52) U.S. Cl.
USPC ..... 463/20; 463/16; 463/42

(58) Field of Classification Search
USPC ..... 463/6, 12, 16, 20, 25, 27, 42
See application file for complete search history.

(56) References Cited

U.S. PATENT DOCUMENTS 5,833,537 A * 11/1998 Barrie ..... 463/21
6,142,872 A 11/2000 Walker et al.
6,312,332 B1 11/2001 Walker et al.
6,361,441 B1 3/2002 Walker et al.
6,712,699 B2 3/2004 Walker et al.
7,364,510 B2 4/2008 Walker et al.
7,662,040 B2 2/2010 Englman et al.
7,780,531 B2 8/2010 Englman et al.
7,833,094 B2 11/2010 Englman et al.
2005/0148382 A1 7/2005 Fox
2007/0072665 A1* 3/2007 Muir ..... 463/12
2007/0155465 A1* 7/2007 Walker et al. ..... 463/16
2007/0155473 A1 7/2007 Powell et al.
2007/0167238 A1* 7/2007 Gatto et al. ..... 463/42
2008/0026848 A1* 1/2008 Byng ..... 463/42
2009/0093298 A1 4/2009 Michel (Continued)

FOREIGN PATENT DOCUMENTS

WO WO2007/030733 3/2007
WO WO2008/045398 4/2008

(Continued)

OTHER PUBLICATIONS

Patent Examination Report No. 1, Australian Application No. 2012201236, Mar. 1, 2013, 5 pages.

*Primary Examiner* — Dmitry Suhol
*Assistant Examiner* — Jason Yen
(74) *Attorney, Agent, or Firm* — Nixon Peabody LLP

(57) ABSTRACT

A method of conducting a community game includes displaying a first outcome of the community game for each player. The outcomes are indicated by a plurality of symbols on one or more display devices. At least one processor is used to determine which of the first outcomes has optimal symbols from the plurality of symbols for achieving the highest payout during continued play of the community game. The one or more display devices are used to display a second outcome for each player. The second outcomes are at least partially based on the optimal symbols from the first outcome determined to have the optimal symbols for the continued community game. The second outcome of the first player is different from the second outcome of the second player.

28 Claims, 15 Drawing Sheets

(56) References Cited

U.S. PATENT DOCUMENTS

| | | | | |
|---|---|---|---|---|
| 2009/0247256 | A1* | 10/2009 | Barnes, II et al. | 463/17 |
| 2010/0029363 | A1* | 2/2010 | Hoffman et al. | 463/20 |
| 2010/0056261 | A1* | 3/2010 | Englman et al. | 463/25 |
| 2010/0099480 | A1 | 4/2010 | Caputo | |
| 2010/0137047 | A1* | 6/2010 | Englman et al. | 463/6 |
| 2010/0137056 | A1* | 6/2010 | Hoffman et al. | 463/21 |
| 2010/0197377 | A1* | 8/2010 | Aoki et al. | 463/20 |
| 2010/0222123 | A1 | 9/2010 | Hornik | |
| 2010/0234090 | A1* | 9/2010 | Thomas | 463/20 |
| 2010/0267439 | A1* | 10/2010 | Englman et al. | 463/20 |
| 2011/0065493 | A1* | 3/2011 | Parham | 463/20 |
| 2011/0098107 | A1* | 4/2011 | Gomez et al. | 463/27 |

FOREIGN PATENT DOCUMENTS

| | | | |
|---|---|---|---|
| WO | WO2008/048634 | 4/2008 | |
| WO | WO2008/133850 | 11/2008 | |
| WO | WO 2008/156846 | * 12/2008 | A63F 9/24 |
| WO | WO2009/061696 | 5/2009 | |
| WO | WO2010/002794 | 1/2010 | |
| WO | WO2010/096784 | 8/2010 | |

* cited by examiner

COMMUNITY GAME USING OPTIMAL OUTCOME FROM INDIVIDUAL PORTION IN SUBSEQUENT COMMUNITY PORTION

CROSS-REFERENCE TO RELATED APPLICATION

This application claims the benefit of U.S. Provisional Application No. 61/451,538, filed Mar. 10, 2011, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus, and methods for playing wagering games, and more particularly, to wagering games using an optimal outcome from an individual portion of a game in a subsequent community portion of the game.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Some of the wagering games played on the gaming machines include a basic wagering game and a bonus game.

SUMMARY OF THE INVENTION

According to one aspect of the present disclosure, a method of conducting a wagering game including a basic wagering game and a community bonus game includes receiving, via at least one input device, wagers from a plurality of players of the wagering game to play the basic wagering game and triggering the community bonus game for at least a first player and a second player. The community bonus game is conducted, which includes displaying, on at least one display, a first set of randomly determined outcomes for a first part of the community bonus game for each player. The first set of randomly determined outcomes includes a last outcome for each player. The last outcome for at least the first player is different than the last outcome for the second player. At least one processor is used to determine which of the last outcomes is optimal for achieving a certain award within the community bonus game. An optimal aspect of the optimal last outcome is applied to at least the first player and the second player. For the first player, a second part of the community bonus game is continued with the optimal aspect applied such that an outcome of the second part of the community game for the first player is based on a combination of the optimal aspect and a first newly added aspect from the second part of the community bonus game. For the second player, the second part of the community bonus game is continued with the optimal aspect applied such that an outcome of the second part of the community game for the second player is based on a combination of the optimal aspect and a second newly added aspect from the second part of the community bonus game.

According to one aspect of the present disclosure, a method of conducting a wagering game including a community bonus game includes receiving, via respective input devices, wagers from players of the wagering game and triggering the community bonus game. At least one display is used to display a first bonus game outcome for each player. The first bonus game outcome is different for at least two of the players. At least one processor is used to determine which of the first bonus game outcomes for the players is optimal for achieving the highest payout during a continued portion of the community bonus game. The continued portion of the community bonus game is continued so as to achieve a second bonus game outcome for each player. The second bonus game outcome for each player is at least partially based on the determined optimal first bonus game outcome so as to provide each player with an equal opportunity to achieve the highest payout during the continued portion of the community bonus game.

According to one aspect of the present disclosure, a method of conducting a community game for at least a first player and a second player includes displaying, via one or more display devices, a first outcome of the community game for each player. The outcomes are indicated by a plurality of symbols on the one or more display devices. At least one processor is used to determine which of the first outcomes has optimal symbols from the plurality of symbols for achieving the highest payout during continued play of the community game. The one or more display devices display a second outcome for each player. The second outcomes are at least partially based on the optimal symbols from the first outcome determined to have the optimal symbols for the continued community game. The second outcome of the first player is different from the second outcome of the second player.

According to one aspect of the present disclosure, a method of conducting a community game for a plurality of players includes displaying, via one or more display devices, a first set of outcomes for a first part of the community game for at least a first player and a second player. The first set of outcomes results in a first-part-final outcome for each player. At least one of the outcomes includes a persistent symbol that persists during the first part of the community game such that the first-part-final outcome for one of the players includes at least one persistent symbol appearing in a previous outcome in the first set of outcomes. The first-part-final outcome for at least the first player is different that the first-part-final outcome for the second player. At least one processor is used to determine which of the first-part-final outcomes is optimal for achieving the highest payout within the community game. The one or more display devices displays a second set of outcomes for at least the first player and the second player. The second set of outcomes is based on a combination of the determined optimal first-part-final outcome and a newly added aspect of a second part of the community game.

According to one aspect of the present disclosure, a method of conducting a community game for a plurality of players includes displaying, via one or more display devices, a first set of outcomes for at least a first player and a second player. Each of the outcomes includes a plurality of symbol locations having respective symbols that indicate a randomly selected outcome of the community game. At least one of the symbols in at least one of the outcomes for the first player is altered to change the function of the symbol in a particular one of the plurality of symbol locations. The altered symbol in the particular symbol location is maintained in subsequent outcomes in the first set of outcomes for the first player. The first set of outcomes results in an intermediate outcome for each player. The intermediate outcome of the first player is different from the intermediate outcome for the second player. At least one processor determines which of the intermediate outcomes for the players is optimal for achieving a certain award during a continued portion of the community game. The one or more display devices displays a second set of outcomes for each player in the continued portion of the community game. The second set of outcomes for each player is at least partially based on the determined optimal intermediate outcome so as to provide each player with an equal opportunity to achieve the certain award during the continued portion of the community game.

According to one aspect of the present disclosure, a method of conducting a community bingo game for a plurality of players includes displaying during a first portion of the community bingo game, via one or more display devices, a first game card for at least a first player and a second player. Each first game card includes a plurality of symbol locations having respective symbols such that the plurality of symbol locations form an array of symbols. The array of symbols is at least partially different for each first game card. During the first portion, one or more processors is used to randomly select a portion of the symbols included in the array of symbols on at least one of the first game cards. The one or more display devices is used to alter the randomly selected symbols on each of the first game cards including selected symbols to indicate that the symbols were randomly selected. The one or more processors is used to determine at the end of the first portion which of the first game cards for the players is optimal for achieving the highest payout during a continued portion of the community bingo game. The continued portion of the community bingo game is continued including displaying, via the one or more display devices, a second game card for each one of the players. The second game card for each player is at least partially based on the determined optimal first game card.

Additional aspects of the invention will be apparent to those of ordinary skill in the art in view of the detailed description of various embodiments, which is made with reference to the drawings, a brief description of which is provided below.

Figure 1:
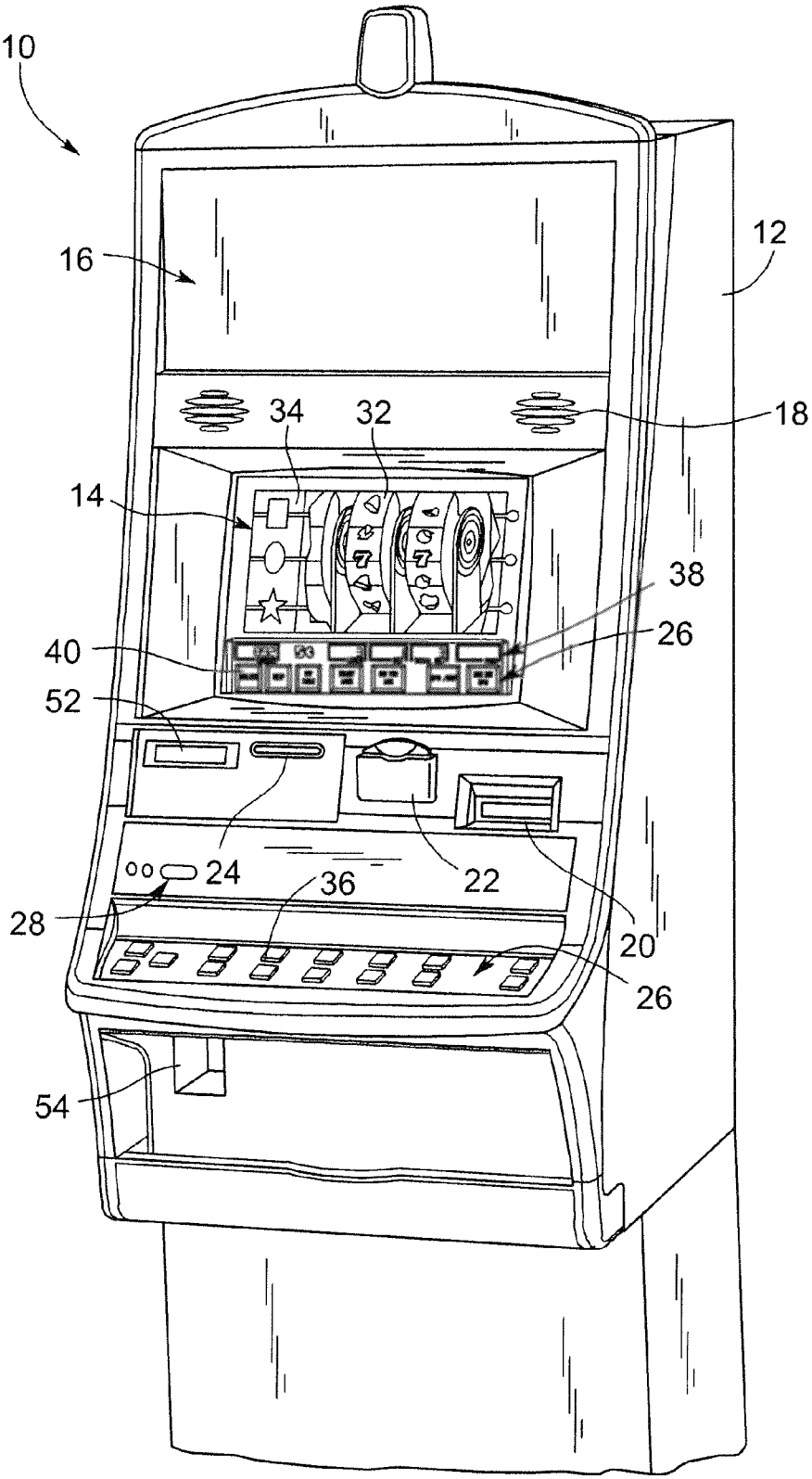
FIG. 1 is a perspective view of a free-standing gaming terminal according to an embodiment of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 is be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 26, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354 entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
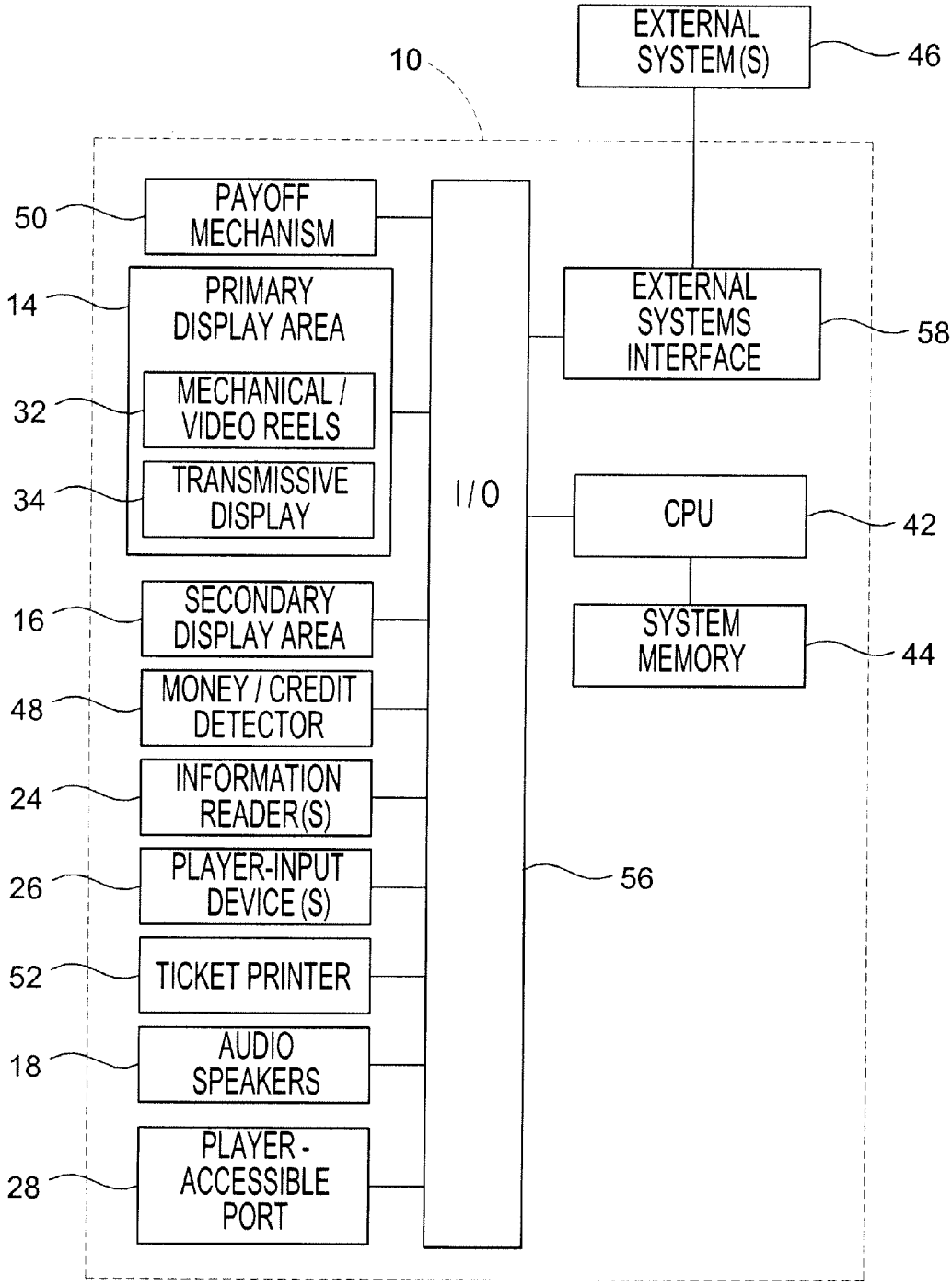
FIG. 2 is a schematic view of a gaming system according to an embodiment of the present disclosure.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
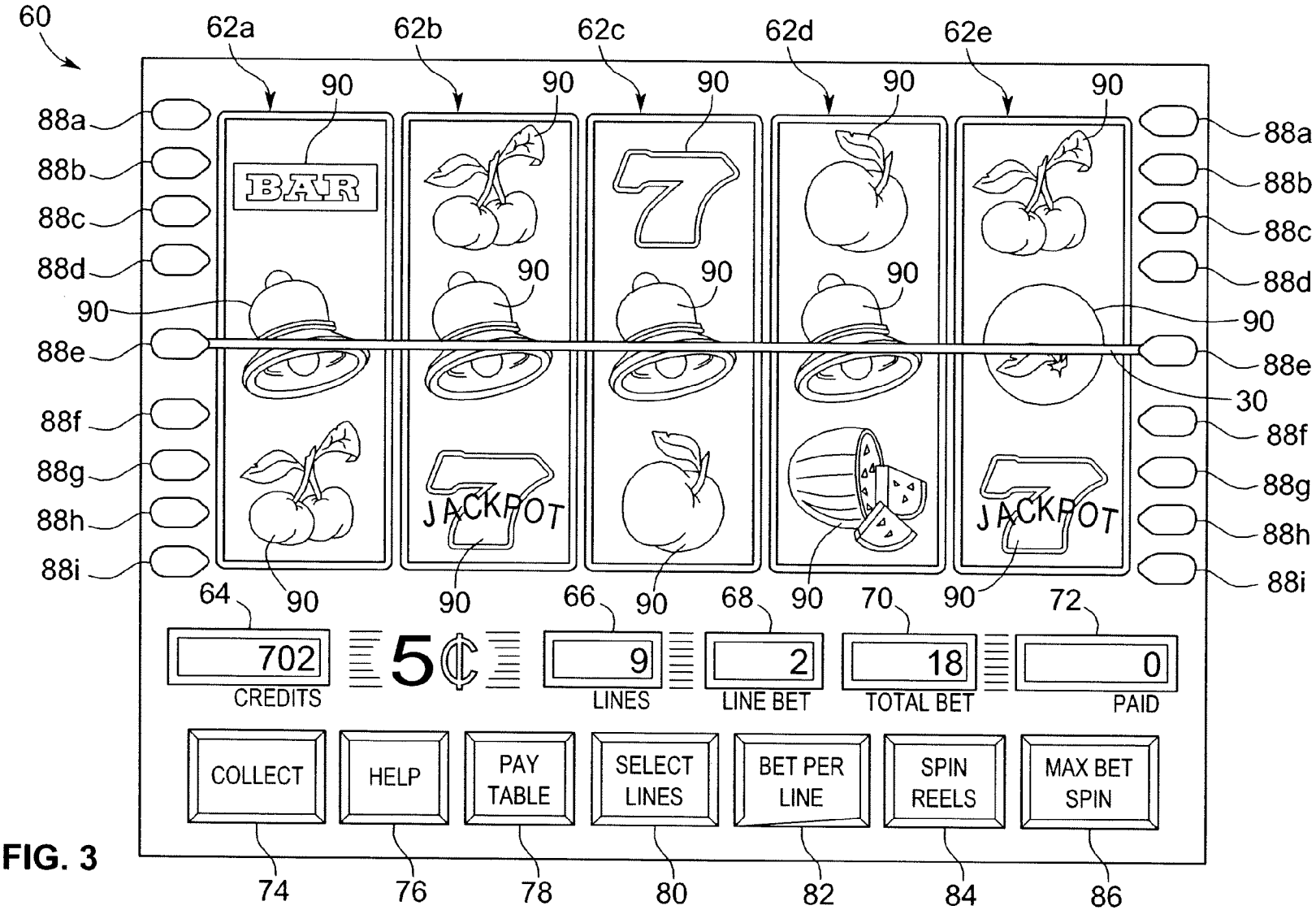
FIG. 3 is an image of an exemplary basic-game screen of a wagering game displayed on a gaming terminal, according to an embodiment of the present disclosure.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown in FIG. 3, different embodiments of the gaming terminal 10 comprise a greater or lesser number of reels in accordance with the present invention.

Figure 4A:
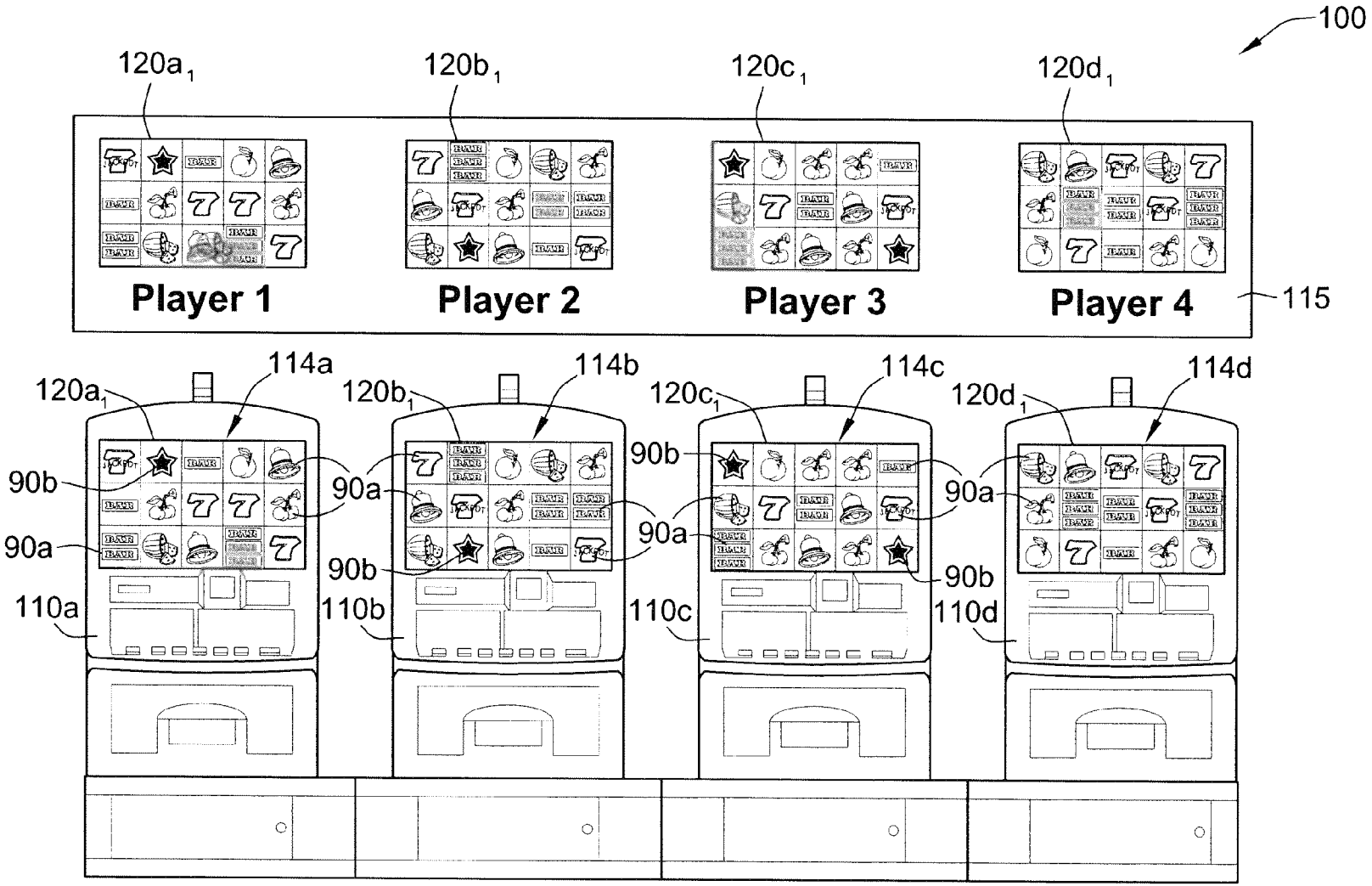
FIGS. 4A-4C are front views of a first part of a community game for a plurality of players according to an embodiment of the present disclosure.

Referring now to FIG. 4A, a community game system 100 for at least conducting a community bonus game is shown. The community game system 100 includes four gaming terminals 110*a-d* and an overhead display 115. Each of the gaming terminals 110*a-d* could be the same as, or different from, the gaming terminal 10 described above.

In response to the community bonus game being triggered, such as, for example, during play of a basic wagering game on one or more of the gaming terminals 110*a-d* of the community gaming system 100, the community game system 100 conducts the community bonus game. The community bonus game in FIGS. 4A-6C includes a predetermined number of plays or spins of a slots game, such as the slots game described above in reference to FIG. 3, which results in a randomly determined outcome being displayed for each player for each play of the community bonus game. For example, the community bonus game includes ten free spins of a slots game for each player of the community bonus game, where each play results in a randomly determined outcome. The ten free spins or plays are divided into a first part and a second part of the community bonus game. As such, the first part includes, for example, the first five plays (plays 1-5), which results in a first set of five outcomes, and the second part includes the second five plays (plays 6-10), which results in a second set of five outcomes.

As shown in the non-limiting illustrated example, the community game system 100 can have 4 players, one at each one of the gaming terminals 110*a-d*. Each play or spin of the community bonus game results in a randomly determined outcome for each player. FIG. 4A illustrates first outcomes 120$a_1$-$d_1$ of the first part of the community bonus game. Each of the first outcomes 120$a_1$-$d_1$ includes a plurality of symbol locations having respective symbols 90 randomly arranged in an array and displayed on respective primary display areas 114*a-d* for each of the four players. The symbols 90 include basic symbols 90*a* and persistent symbols 90*b*.

The persistent symbols 90*b* are symbols that randomly appear in any of the outcomes and stay or persist at specific symbol locations within the array of symbols for at least one additional play of the community bonus game. For example, the first outcome 120$a_1$ for player 1 includes a persistent symbol 90*b* in the second reel, top position, as a "Star" symbol. Similarly, the first outcome 120$b_1$ for player 2 includes a persistent symbol 90*b* in the second reel, bottom position; the first outcome 120$c_1$ for player 3 includes a persistent symbol 90*b* in the first reel, top position and in the fifth reel, bottom position; however, the first outcome 120$d_1$ for player 4 does not include a persistent symbol 90*b*.

The persistent symbols 90*b*, in the specific symbol locations, remain as persistent symbols for a predetermined number of spins (1, 2, 3, etc.) or time (10 seconds, 30 seconds, etc.) during play the community bonus game. Put another way, players accumulate or collect persistent symbols for a specified number of additional plays and/or time during play of the community bonus game. For example, persistent symbols 90*b* appearing in any play during the first part of the community bonus game for player 1 are collected by player 1 and persist for all subsequent plays remaining in the first part of the community bonus game for player 1 after initially appearing in an outcome. Thus, for the community bonus game including ten total free plays, where the first part includes the first five plays and the second part includes the second five plays, a persistent symbol appearing in the second play of the first part will persist and remain in the same symbol location in the third, the fourth, and the fifth plays of the first part of the community bonus game.

The persistent symbols 90*b* enhance or aid in awards achieved by the players of the community bonus game. For example, the persistent symbols 90*b* can be "wild" symbols acting as substitutes for other symbols in the array. Alternatively or additionally, the persistent symbols 90*b* can be multipliers applied to awards achieved by the player. These and other aspects of persistent symbols are discussed in commonly assigned U.S. Patent Publication No. 2010-0197377, entitled "Wagering Game with Persistent Wild Symbol Reel Position," which is hereby incorporated by reference in its entirety.

Optionally, the outcomes (e.g., the first outcomes 120$a_1$-$d_1$) can be duplicated/displayed on the overhead display 115 such that players of the individual gaming terminals 110*a-d* can view the outcomes and persistent symbols accumulated by the other players of the community bonus game. Displaying some or all of the outcomes of the players on the overhead display 115 can increase camaraderie among the players and also add excitement and anticipation to the community bonus game. For example, as will be explained below, optimal aspects from an optimal outcome for achieving a certain award (e.g., highest payout) at the end of the first part of the community bonus game achieved by one of the players can be used by one or more of the other players to enhance the other players' ability to win the certain award (e.g., highest payout) at the end of the community bonus game.

Figure 4B:
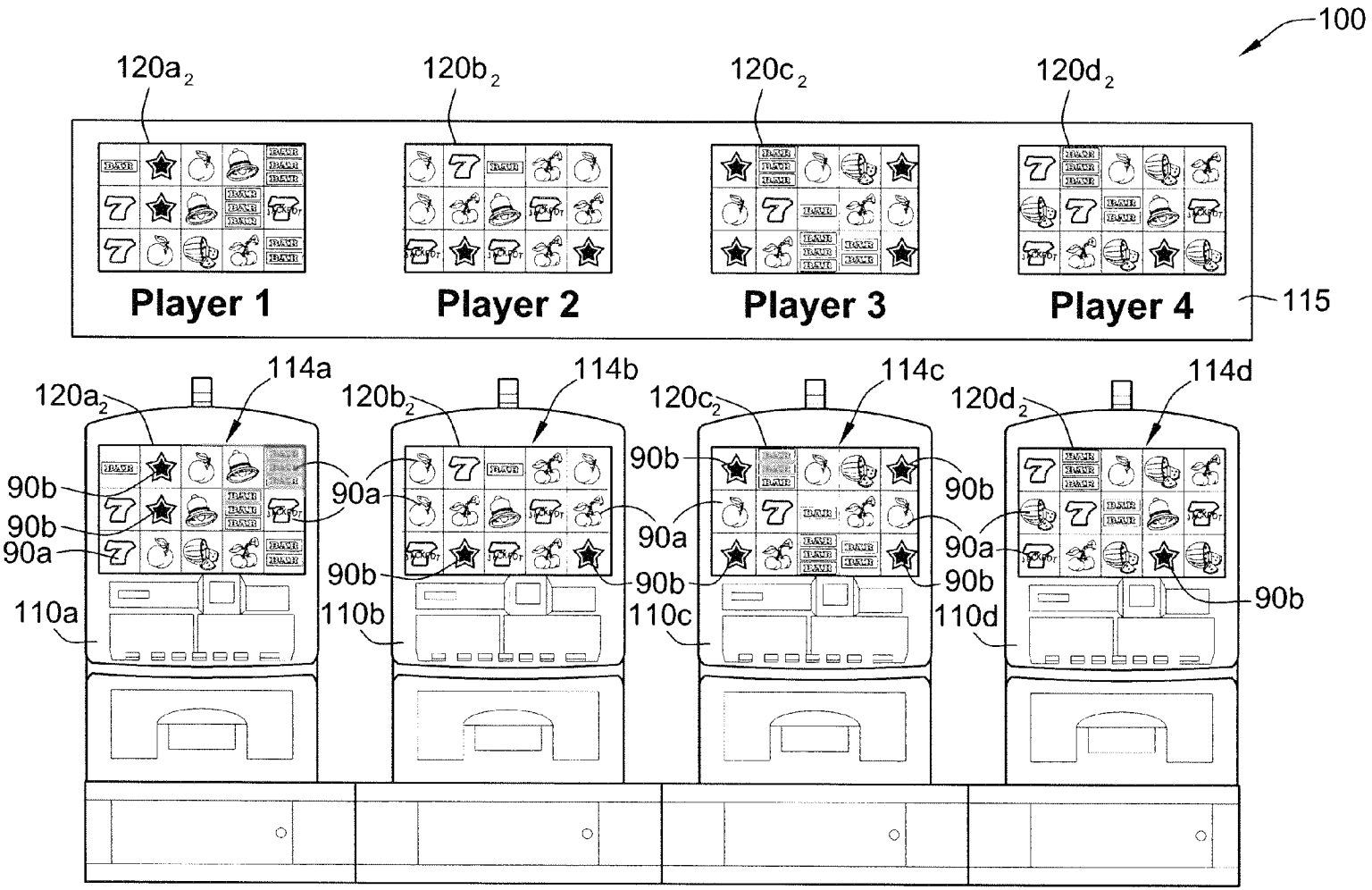

Referring to FIG. 4B, second outcomes 120$a_2$-$d_2$ of the first part of the community bonus game are shown. The second outcomes 120$a_2$-$d_2$ are similar to the first outcomes 120$a_1$-$d_1$ of the first part of the community bonus game in that each of the second outcomes 120$a_2$-$d_2$ includes an array of randomly selected symbols 90. However, the second outcomes 120$a_2$-$d_2$ include each of the persistent symbols 90*b* in exactly the same symbol location that they originally appeared in the first outcomes 120$a_1$-$d_1$ plus any additional persistent symbols 90*b* that randomly appeared in the second outcomes 120$a_2$-$d_2$.

For example, in the second outcome 120$a_2$ for player 1, the persistent symbol 90*b* in the second reel, top position, was collected by player 1 and persisted from the first outcome 120$a_1$ such that it remained as part of the second outcome 120$a_2$ in addition to a new persistent symbol 90*b* in the second reel, middle position. Similarly, a new persistent symbol 90*b* is included in the second outcome 120$b_2$ for player 2 in the fifth reel, bottom position; new persistent symbols 90*b* are included in the second outcome 120$c_2$ for player 3 in the first reel, bottom position and in the fifth reel, top position; a new persistent symbol 90*b* is included in the second outcome 120$d_2$ for player 4 in the fourth reel, bottom position. Additionally, as shown by comparing the first outcomes 120$a_1$-$d_1$ with the second outcomes 120$a_2$-$d_2$, the persistent symbols 90*b* for players 1, 2, and 3 that initially appeared in the first outcomes 120$a_1$, 120$b_1$, and 120$c_1$ remain/persist in the second outcomes 120$a_2$, 120$b_2$, and 120$c_2$, respectively.

Figure 4C:
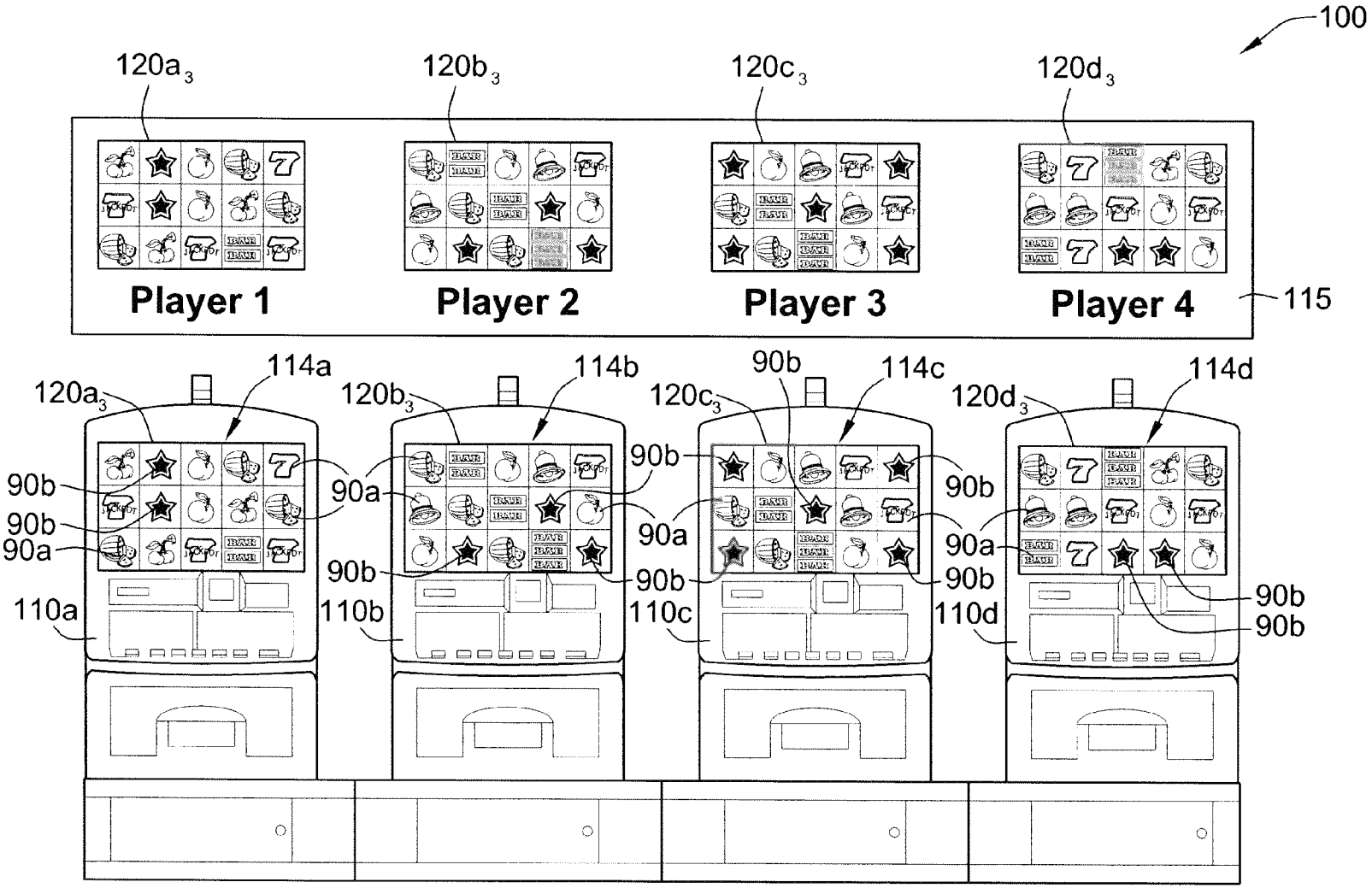

Referring to FIG. 4C, third outcomes 120$a_3$-$d_3$ of the first part of the community bonus game are shown. The third outcomes 120$a_3$-$d_3$ are similar to the first and second outcomes 120$a_1$-$d_1$, 120$a_2$-$d_2$ of the first part of the community bonus game in that each of the third outcomes 120$a_3$-$d_3$ includes an array of randomly selected symbols 90*a,b*. However, the third outcomes 120$a_3$-$d_3$ include each of the persistent symbols 90*b* in exactly the same symbol location that they originally appeared in the first outcomes 120$a_1$-$d_1$ and in the second outcomes 120$a_2$-$d_2$ plus any additional persistent symbols 90*b* that randomly appeared in the third outcomes 120$a_3$-$d_3$.

For example, in the third outcome 120$b_3$ for player two, the persistent symbols 90*b* in the second reel, bottom position and in the fifth reel, bottom position were collected by player 2 and persisted from the first outcome 120$b_1$ and the second outcome 120$b_2$, respectively, such that they remained as part of the third outcome 120$b_3$ in addition to a new persistent symbol 90*b* in the fourth reel, middle position. Similarly, a new persistent symbol 90*b* is included in the third outcome 120$c_3$ for player 3 in the third reel, middle position; a new persistent symbol 90*b* is included in the third outcome 120$d_3$ for player 4 in the third reel bottom position. No new persistent symbol was added in the third outcome 120$a_3$ for player 1. Additionally, as shown by comparing the third outcomes 120$a_3$-$d_3$ with the first and the second outcomes 120$a_1$-$d_1$ and 120$a_2$-$d_2$, the persistent symbols 90*b* for all players that initially appeared in the first and the second outcomes 120$a_1$-$d_1$ and 120$a_2$-$d_2$ remain/persist in the third outcomes 120$a_3$-$d_3$.

In response to the first part of the community bonus game concluding, which may, for example, occur after the third outcomes 120$a_3$-$d_3$ are displayed to the players, the community game system 100 determines, using one or more processors, which of the third outcomes 120$a_3$-$d_3$ (i.e., the last outcome of the first part of the community bonus game) is optimal for achieving a certain award within the community bonus game. That is, the community game system 100 evaluates the last outcome in the first part of the community bonus game to determine which one of the last outcomes among all players of the community bonus game is optimal for achieving a certain award at the end or conclusion of the community bonus game, such as at the end of the second part of the community bonus game.

According to some aspects of the present disclosure, determining the optimal outcome means determining which one of the last outcomes in the first part of the community bonus game has the highest probability of achieving the highest payout within the community bonus game based on the number and/or orientation of the persistent symbols 90*b* in each of the last outcomes (e.g., outcomes 120$a_3$-$d_3$). Depending on the number and type of active paylines implemented in the community bonus game, the impact of the location of persistent symbols 90*b* on achieving certain winning outcomes can vary. The community game system 100 can analyze these variables, among other things, when determining which outcome is optimal. However, it is contemplated that the optimal outcome can simply be the outcome including the most persistent symbols, regardless of the location of the persistent symbols 90*b* therein.

Figure 5:
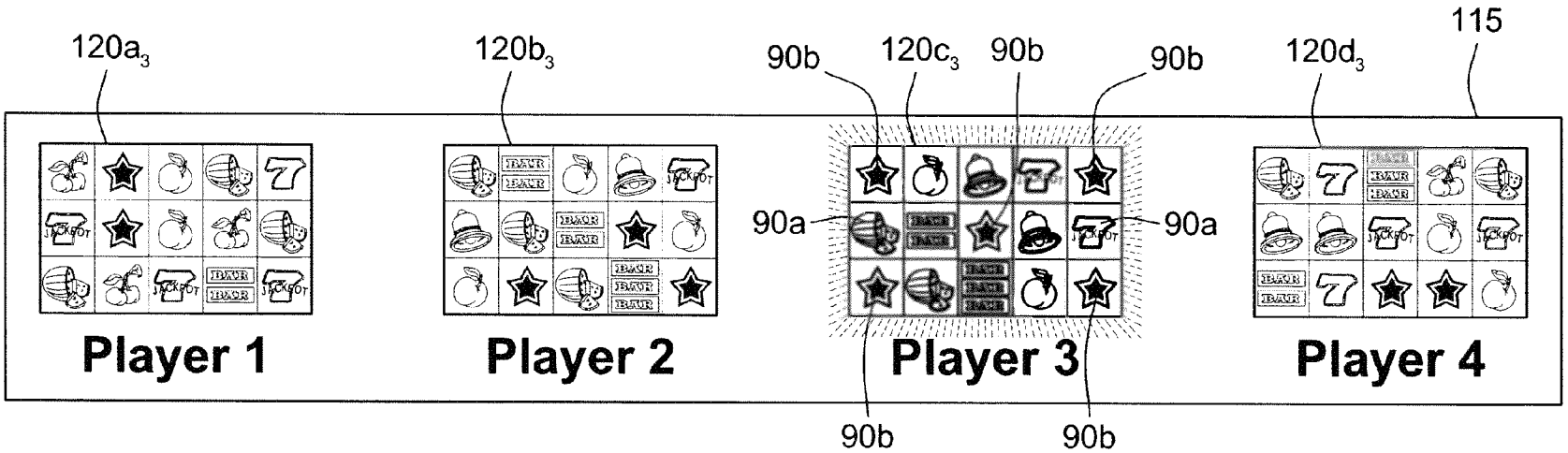
FIG. 5 is a front view of a portion of the community game of FIGS. 4A-4C indicating an optimal outcome among the players according to an embodiment of the present disclosure.

Now referring to FIG. 5, in the illustrated example, the community game system 100 determined that player 3's third outcome 120$c_3$ (e.g., last or final outcome in the first part) is optimal for achieving a certain outcome within the community bonus game. To indicate that determination, player 3's third outcome 120$c_3$ is highlighted and/or circled on the overhead display 115. Various means of indicating the determined optimal outcome are contemplated, such as, for example, flashing the determined optimal outcome on the overhead display 115, highlighting and/or bolding the determined optimal outcome on the overhead display 115, etc.

Figure 6A:
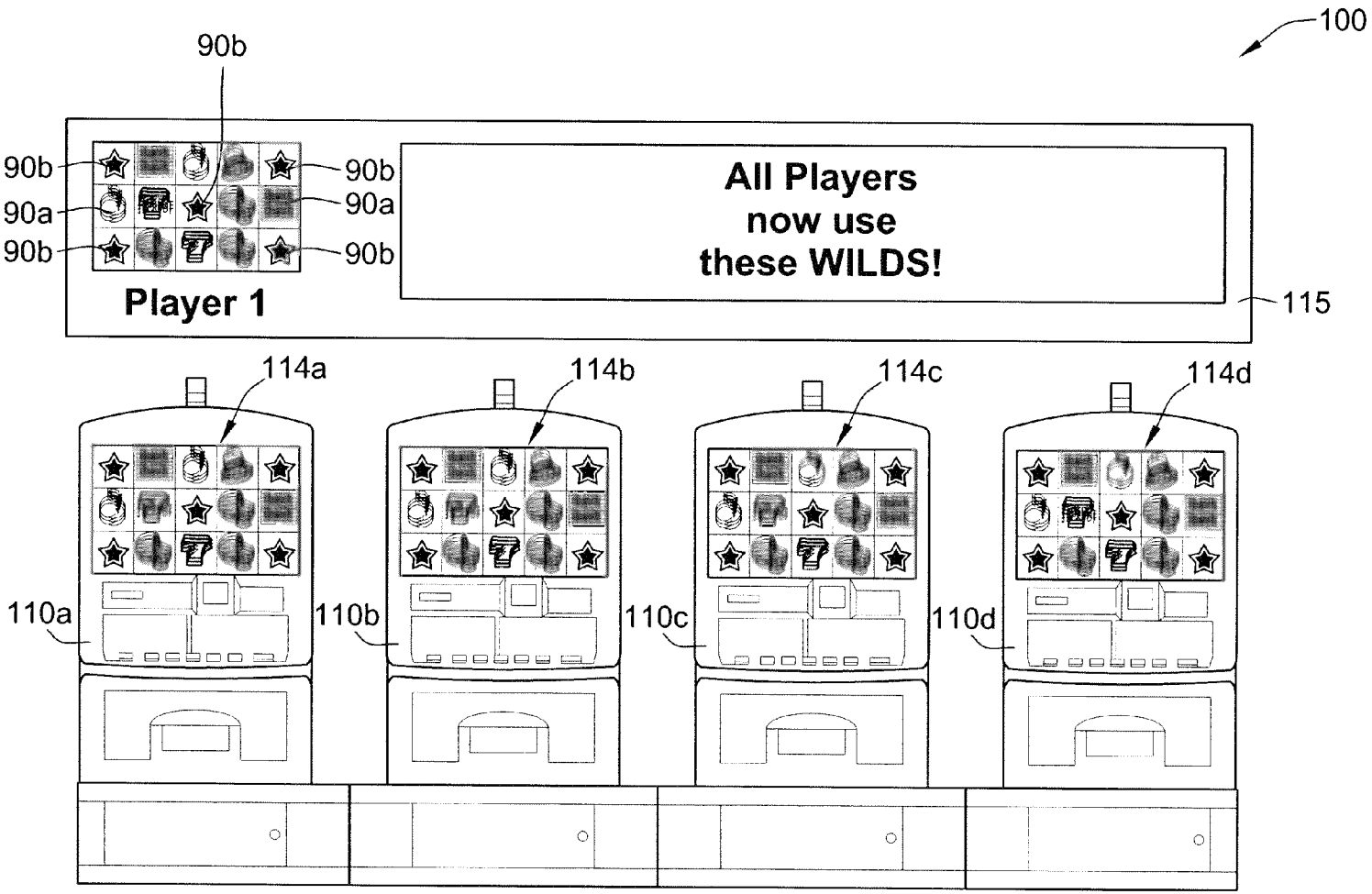
FIG. 6A is a front view of a second part of the community game of FIGS. 4A-4C according to an embodiment of the present disclosure.
Figure 6B:
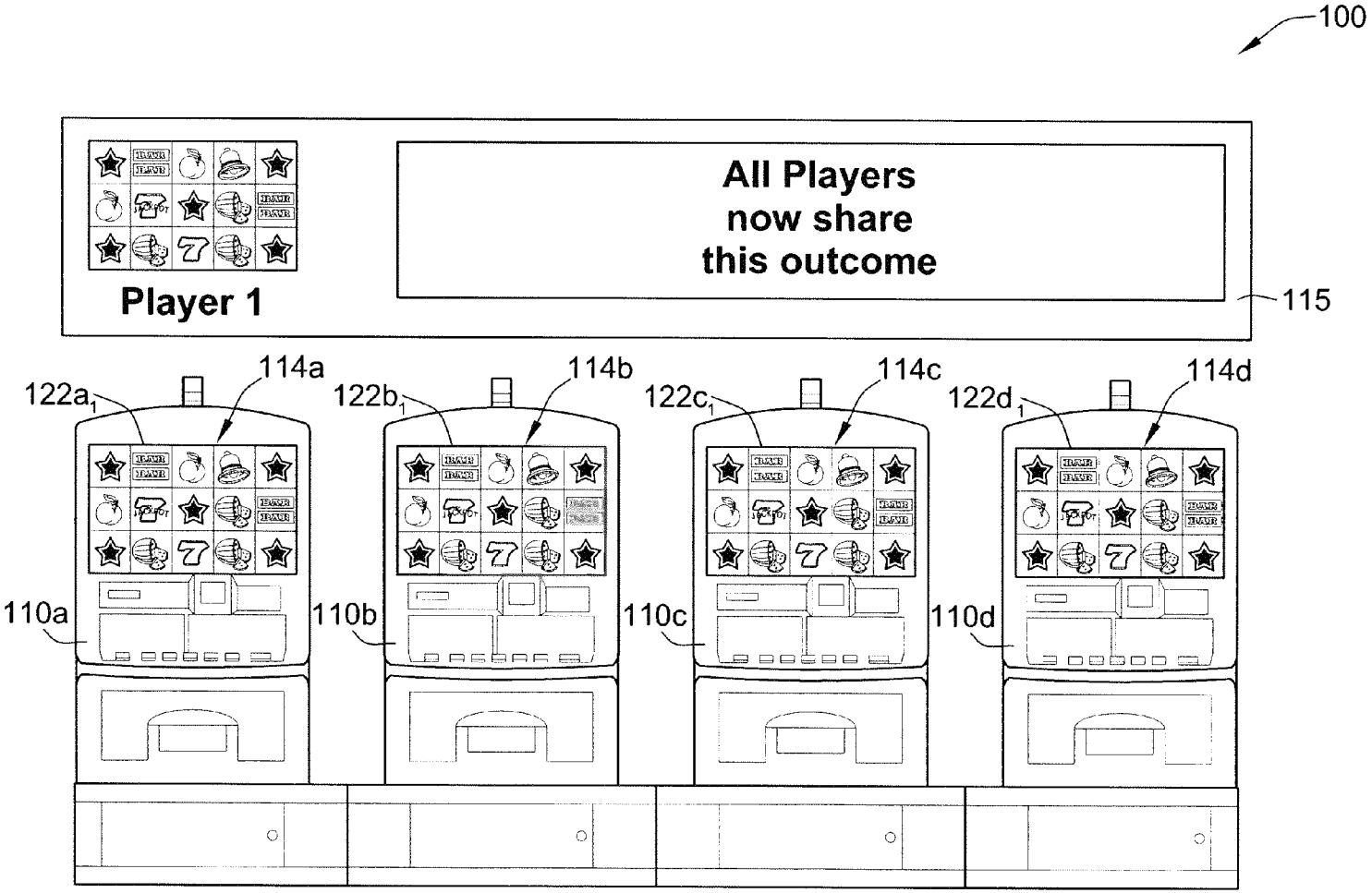
FIG. 6B is a front view of the second part of the community game of FIG. 6A illustrating a shared outcome among all the players according to an embodiment of the present disclosure.
Figure 6C:
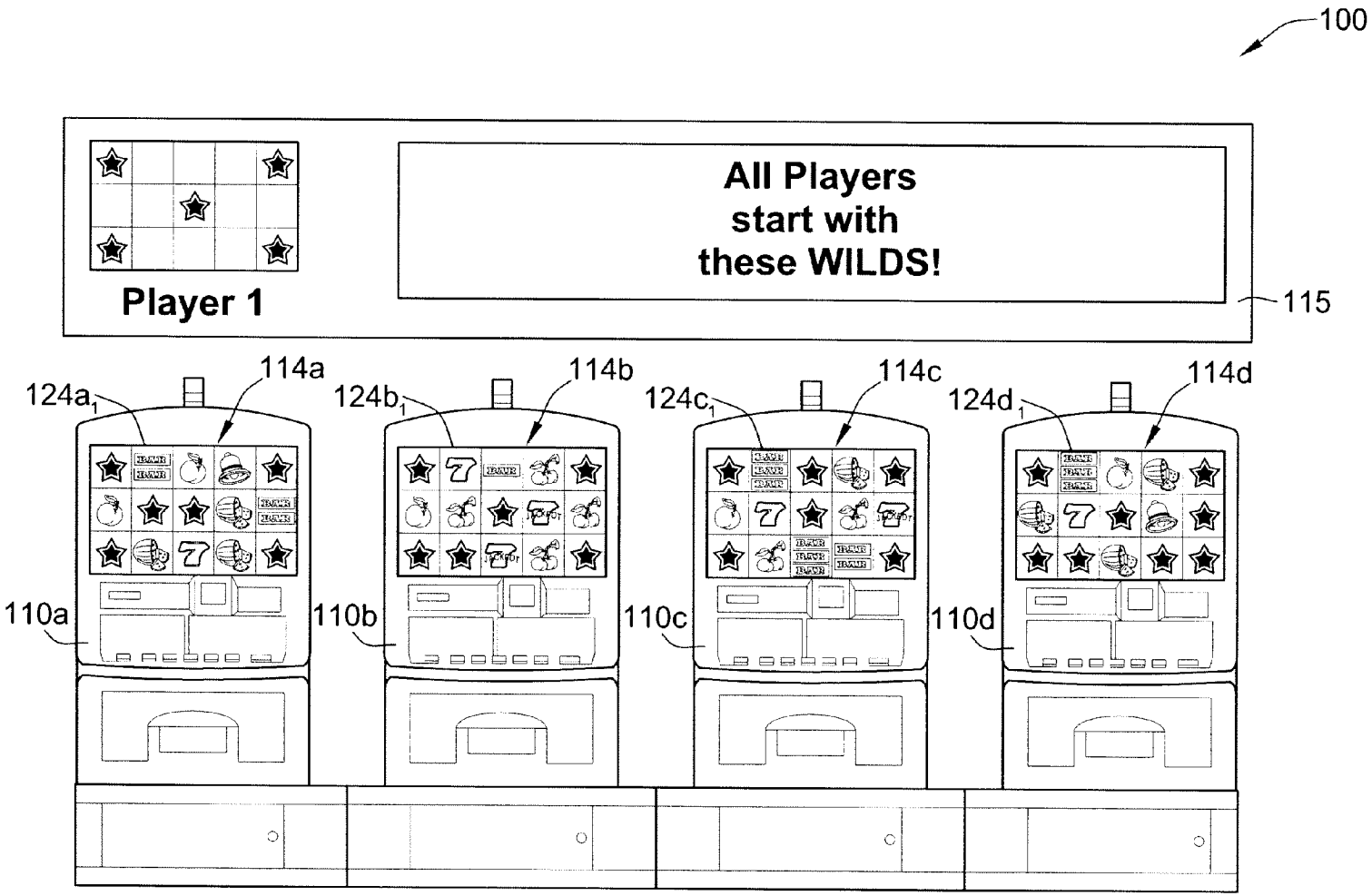
FIG. 6C is a front view of the second part of the community game of FIG. 6A illustrating different outcomes among all the players according to an embodiment of the present disclosure.

Now referring to FIG. 6A, in response to the community game system 100 determining that player 3's last outcome of the first part of the community bonus game is optimal, an optimal aspect of the determined optimal last outcome is applied during the second part of the community bonus game to outcomes achieved by at least one of the players. For example, as shown in FIG. 6A, all of the accumulated persistent symbols 90*b* included in player 3's third outcome 120$c_3$ (i.e., the determined optimal outcome) at their respective symbol locations within the array of symbols, are copied and applied onto the primary display areas 114*a-d* of all the gaming terminals 110*a-d* for use during play of the second part of the community bonus game.

During a first play or spin of the second part of the community bonus game, each of the four players starts with all of the persistent symbols 90*b* (e.g., the optimal aspect) that were included in the determined optimal outcome. Thus, the first outcome of the second part of the community bonus game for each player is based on a combination of the optimal aspect and a newly added aspect from the second part of the community bonus game. The optimal aspect can be the persistent symbols 90*b* and the newly added aspect can be a combination of randomly selected basic symbols 90*a* and/or one or more additional persistent symbols 90*b*.

Applying the optimal aspect to the second part of the community bonus game for each player provides each player with an equal opportunity to achieve the highest payout at the end of the community bonus game. In some implementations of the present concepts, each player always achieves the same award at the end of the second part of the community bonus game no matter how many plays are included in the second part of the community bonus game. As shown, for example, in FIG. 6B, all players share the same outcome achieved in the second part of the community bonus game. In such an illustrative example, outcomes 122$a_1$-$d_1$ of the second part of the community bonus game are identical for each player, which results in the same award being achieved by each player.

In other implementations of the present concepts, each player starts with the same optimal aspect applied (e.g., same number and orientation of persistent symbols 90*b*), but achieves different awards at the end of the second part of the community bonus game. As shown, for example, in FIG. 6C, at least two or more of the players achieve different outcomes in the second part of the community bonus game. In such an illustrative example, outcomes 124$a_1$-$d_1$ of the second part of the community bonus game are different for each player, which results in different awards being achieved by each player depending on the pay table associated with the community bonus game. However, because (1) the players started the second part of the community bonus game with an equal number and orientation of persistent symbols 90*b* (optimal aspect) and (2) the outcomes 124$a_1$-$d_1$ are based on randomly determined symbol arrays in combination with the same optimal aspect, while the players achieve different outcomes 124$a_1$-$d_1$ in the second part of the community bonus game, the players at least had equal opportunities to achieve the highest payout at the end of the community bonus game.

Generally referring to FIGS. 7-10B, a community bingo game is described according to some aspects of the present disclosure. Each of the images or screenshots 130-134 of FIGS. 7-10B can be displayed on any one of the primary display areas 114*a-d* of the gaming terminals 110*a-d*, the overhead display 115, other displays, or a combination thereof, to any player of the community bingo game. The community bingo game is similar to the slots-type community bonus game described above in reference to FIGS. 4A-6C in that the community bingo game can be a bonus game that is triggered during play of a basic wagering game on one or more of the gaming terminals 110*a-d* of the community gaming system 100.

In response to the community bingo game being triggered, the community game system 100 conducts the community bingo game. The community bingo game of the present disclosure, as illustrated in FIGS. 7-10B, includes ten players. The screenshot 130 is displayed to each of the ten players on respective display devices including ten game cards 140*a-j*. Each of the players is associated with one of the game cards 140*a-j* (e.g., player 1 is associated with the first game card 140*a*, player 2 is associated with the second game card 140*b*, etc.).

Each of the game cards 140*a-j* includes a plurality of symbol locations having respective symbols 190 such that the plurality of symbol locations form an array of symbols. The array of symbols for each one of the game cards 140*a-j* is at least partially different. Each of the symbols 190 includes an integer number (e.g., 1, 2, 10, 34, 55, 79, etc.), except for one of the symbols 190 included in the array of symbols for each game card 140*a-j* that is a "FREE" space symbol as commonly used in bingo games.

Figure 7:
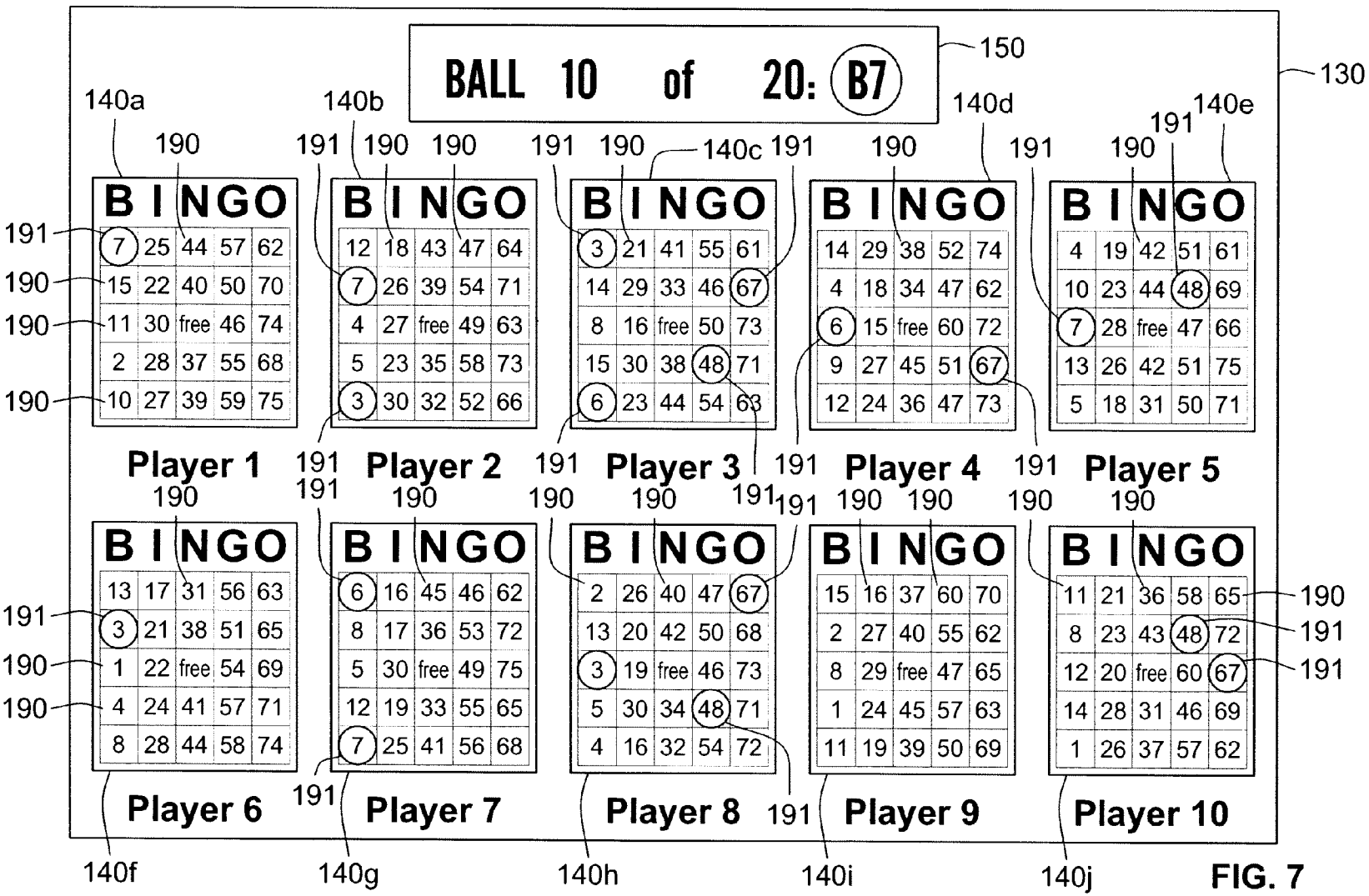
FIG. 7 is an image of a first part of a community game for a plurality of players according to an embodiment of the present disclosure.

The community bingo game includes a predetermined number of plays (e.g., 20 plays), where one of the basic symbols 190 potentially included in one or more of the game cards 140*a-j* is randomly selected and displayed to the players, via box 150, of the community bingo game for each play. As shown in FIG. 7, the randomly selected basic symbol for the tenth play of the community bingo game was B7. According to the illustrated example of FIGS. 7-10B, basic symbols 190 potentially included in one or more of the game cards 140*a-j* include any integer number between 1 and 75, inclusive.

The predetermined number of plays is divided into a first portion of plays (e.g., plays 1-10) displayed during a first portion of the community bingo game and a second portion of plays (e.g., plays 11-20) displayed during a second portion of the community bingo game. The first portion results in a first set of ten cumulative outcomes or a first-portion-game card and the second portion results in a second set of ten cumulative outcomes or a second-portion-game card. Each one of the plays potentially allows the players to become one step closer to achieving a winning outcome. A winning outcome occurs in the community bingo game in response to a particular combination of symbols in the array of symbols on a single game card being randomly selected during the course of the community bingo game as will be described herein.

Referring specifically to FIG. 7, the game cards 140*a-j* are shown after the tenth play (e.g., the end of the first portion) of the first portion of the community bingo game. That is, the ten random selections of basic symbols of the first portion of the community bingo game occurred and the cumulative outcomes of those ten plays are displayed for each of the ten game cards 140*a-j* as the first-portion-game cards 140*a-j*.

In order to indicate that a particular symbol is randomly selected, the selected symbols are altered on each game card 140*a-j* including such symbols to indicate that the symbol was randomly selected. For example, each of the basic symbols "3," "6," "7," "48," "61," and "67" was altered from a basic symbol 190 to a selected symbol 191 by circling the respective basic symbol 190 on any game card including such a basic symbol. For example, in the game card 140*a* associated with player 1, the basic symbol "7" was circled to indicate that one of the plays during the first portion of the community bingo game included randomly selecting "7."

Any altered symbol 191 is maintained in its particular symbol location on each game card 140*a-j* including such a randomly selected symbol throughout the duration of the first portion of the community bingo game. The maintaining of the outcomes for each of the plays of the first portion of the community bingo game results in a cumulative outcome for each player, such as, for example, as shown in FIG. 7 as the first-portion-game cards 140*a-j*. As such, the players can keep track of which basic symbols 190 were randomly selected throughout the first portion and visually see, via the screenshot 130, the orientations of the selected symbols 191 for each of the ten players. Allowing the players to see the selections and orientations of the selected symbols included on their game card and/or on one or more other player's game card adds excitement and anticipation to the community bingo game.

For example, as shown in FIG. 7, the game card 140*a* associated with player 1 includes one selected symbol 191 ("7"). Similarly, the game card 140*b* associated with player 2 includes two selected symbols 191 ("7" and "3"); the game card 140*c* associated with player 3 includes four selected symbols 191 ("3," "6," "48," and "67"); the game card 140*d* associated with player 4 includes two selected symbols 191 ("6" and "67"); the game card 140*e* associated with player 5 includes two selected symbols 191 ("7" and "48"); the game card 140*f* associated with player 6 includes one selected symbol 191 ("3"); the game card 140*g* associated with player 7 includes two selected symbols 191 ("6" and "7"); the game card 140*h* associated with player 8 includes three selected symbols 191 ("3," "48," and "67"); the game card 140*i* associated with player 9 includes zero selected symbols 191; and the game card 140*j* associated with player 10 includes two selected symbols 191 ("48" and "67").

In response to the first portion of the community bingo game concluding, which may, for example, occur after conducting the tenth play of the first portion of the community bingo game, the community game system 100 determines, using one or more processors, which of the first-portion-game cards 140*a-j* is optimal for achieving a certain award (e.g., the highest payout) during a continued portion of the community bingo game. That is, the community game system 100 evaluates the game cards 140*a-j* after the last play in the first portion of the community bingo game to determine which one of the game cards 140*a-j* is optimal for achieving a certain award at the end of the second portion of the community bingo game.

According to some aspects of the present disclosure, determining the optimal first-portion-game card means determining which one of the first-portion-game cards 140*a-j* has the highest probability of achieving the highest payout within the community bingo game based on the number and/or orientation of the selected symbols 191 included in each of the first-portion-game cards 140*a-j*. Depending on the number and type of active paylines implemented in the community bingo game, the impact of the location of selected symbols 191 on achieving certain winning outcomes can vary. The community game system 100 can analyze these variables, among other things, when determining which first-portion-game card 140*a-j* is optimal. However, it is contemplated that the optimal first-portion-game card 140*a-j* can simply be the first-portion-game card including the most selected symbols 191, regardless of the location of the selected symbols 191 therein.

Figure 8:
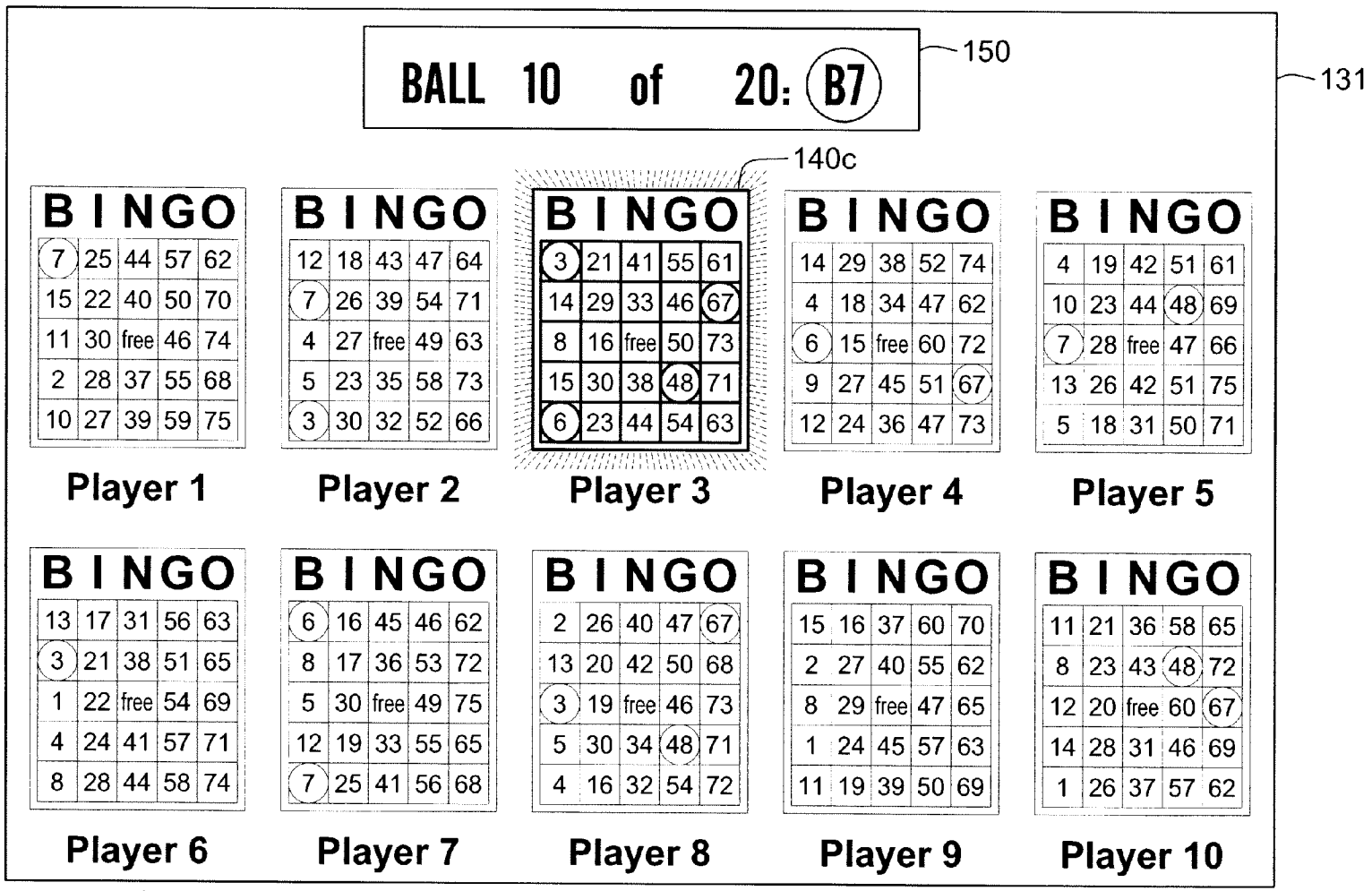
FIG. 8 is an image of the community game of FIG. 7 indicating an optimal outcome among the players according to an embodiment of the present disclosure.

Now referring to FIG. 8, in the illustrated example, the community game system 100 determined that player 3's first-portion-game card 140*c* is optimal for achieving a certain outcome within the community bingo game as compared to the other game cards 140*a-b,d-j*. To indicate that determination, player 3's first-portion-game card 140*c* is highlighted and/or circled on a screenshot 131 displayed to the players. Various means of indicating the determined optimal first-portion-game card are contemplated, such as, for example, flashing an image of the determined optimal first-portion-game card on respective displays, highlighting and/or bolding the determined optimal first-portion-game card, etc.

Figure 9:
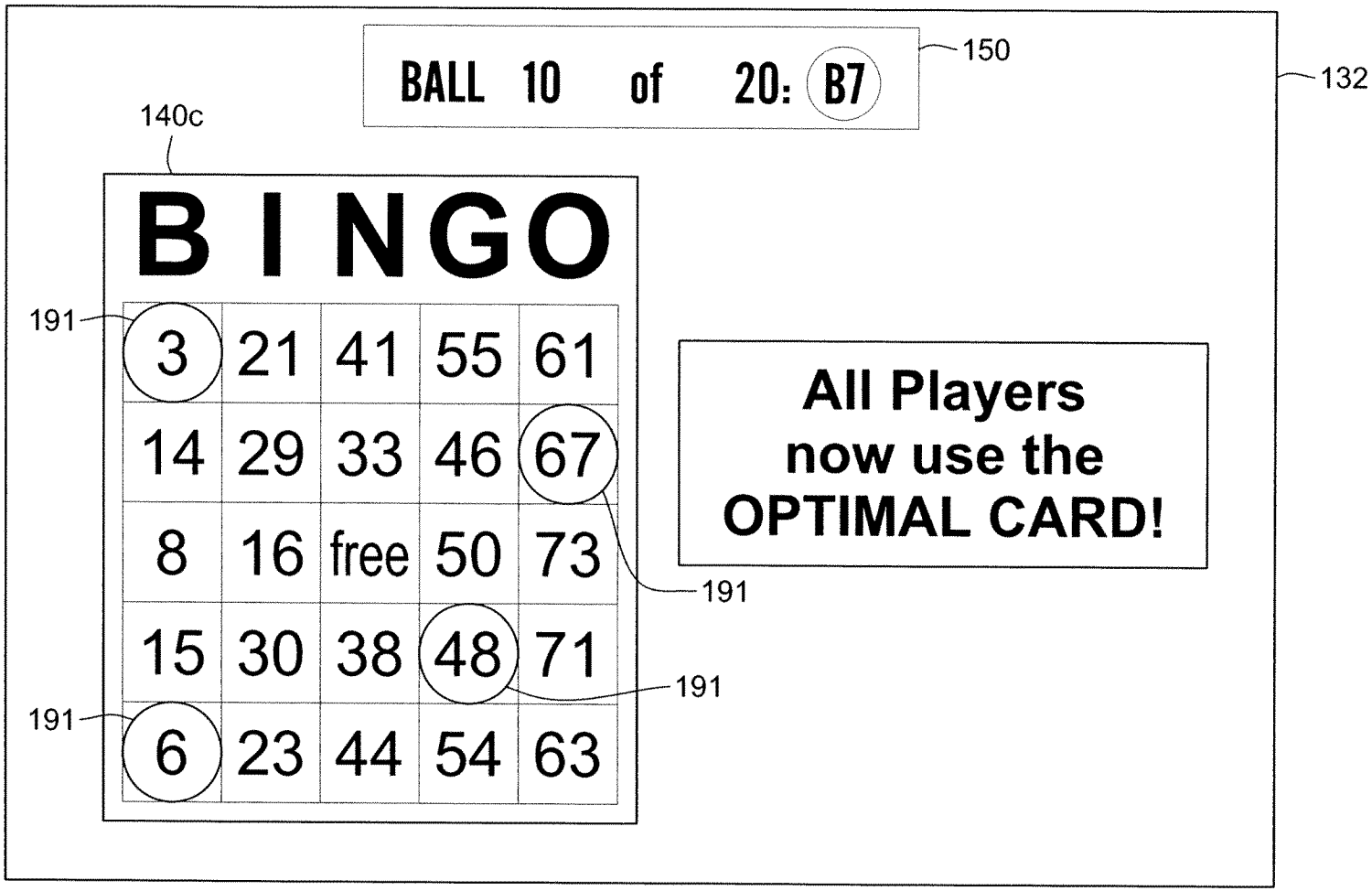
FIG. 9 is an image of a second part of the community game of FIG. 7 illustrating a shared outcome among all the players according to an embodiment of the present disclosure.

Now referring to FIG. 9, in response to the community game system 100 determining that player 3's first-portion-game card 140*c* is optimal, the community bingo game continues with the second portion. As shown in screenshot 132, each player continues to play the second portion using the determined optimal first-portion-game card 140*c* during the second portion of the community bingo game. That is, each player starts the second portion using the determined optimal first-portion-game card 140*c*. For example, as shown in FIG. 9, the same array of symbols and all of the selected symbols 191 included in player 3's first-portion-game card 140*c* is used during play of the second portion of the community bingo game for all of the players. Thus, as each play of the second portion is conducted, every player has the same opportunity for achieving a winning outcome. Additionally, if a winning outcome is achieved during the second portion, the same winning outcome and corresponding award is won by all of the players at the end of the community bingo game because all of the players use the same game card 140*c* for the second portion of the community bingo game.

Figure 10A:
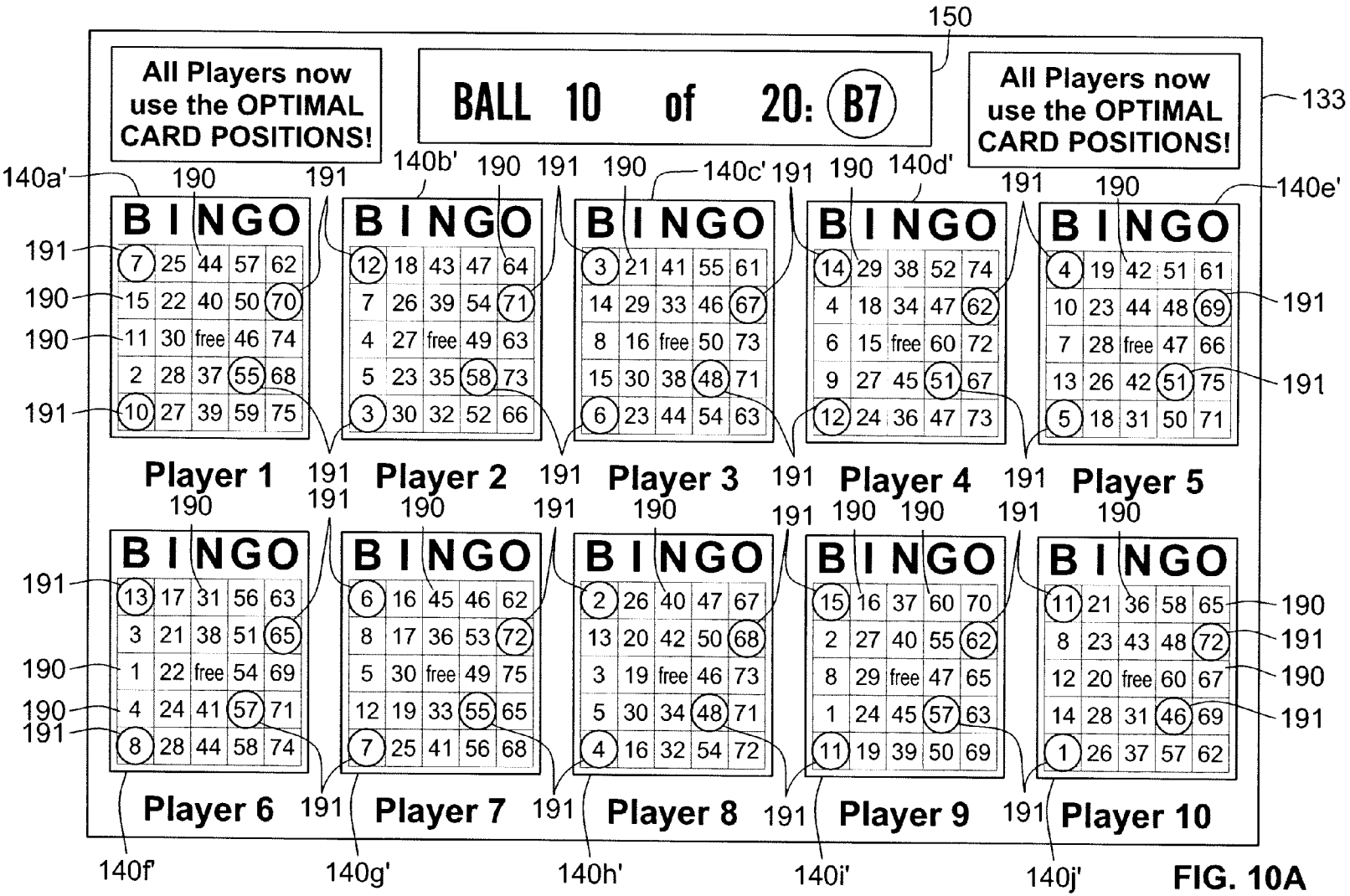
FIGS. 10A-10B are images of a second part of the community game of FIG. 7 illustrating different outcomes among all the players according to an embodiment of the present disclosure.

Referring now to screenshot 133 of FIG. 10A, according to one alternative implementation of the community bingo game, instead of all players using the same game card 140*c* for the second portion of the community bingo game and achieving the same outcomes, each player uses a game card 140*a'-j'* based at least in part on the same game cards 140*a-j* used in the first portion in combination with optimal aspects of the determined optimal game card 140*c* (e.g., some number and orientation of selected symbols 191). That is, the game cards 140*a'-j'* used by each player in the second portion of the community bingo game are the same as the game cards used in the first portion, but include a equal number and orientation of selected symbols 191 for all of the players to start the second portion of the community bingo game.

For example, the game card 140*a'* associated with player 1 includes four selected symbols 191 (7, 10, 55, and 70) to begin the second portion of the community bonus game. Similarly, the game card 140*b'* associated with player 2 includes four selected symbols 191 (12, 3, 58, and 71); the game card 140*c'* associated with player 3 includes four selected symbols 191 (3, 6, 48, and 67); the game card 140*d'* associated with player 4 includes four selected symbols 191 (14, 12, 51, and 62); the game card 140*e'* associated with player 5 includes four selected symbols 191 (4, 5, 51, and 69); the game card 140*f'* associated with player 6 includes four selected symbols 191 (13, 8, 57, and 65); the game card 140*g'* associated with player 7 includes four selected symbols 191 (6, 7, 55, and 72); the game card 140*h'* associated with player 8 includes four selected symbols 191 (2, 4, 48, and 68); the game card 140*i'* associated with player 9 includes four selected symbols 191 (15, 11, 57, and 62); and the game card 140*j'* associated with player 10 includes four selected symbols 191 (11, 1, 46, and 72).

By equal orientation of selected symbols it is meant that the respective sets of four selected symbols 191 in each of the game cards 140*a'-j'* correspond with selected symbols 191 in corresponding symbol locations, such as, for example, the first column, first position; the first column, fifth position; the fourth column, fourth position; and the fifth column, second position, respectively, in the determined optimal first-portion-game card 140*a* also including selected symbols 191 randomly selected during play of the first portion of the community bingo game.

While each player begins the second portion of the community bingo game with the same number and orientation of selected symbols in FIG. 10A, because the game cards 140*a'-j'* have different arrays of basic symbols 190, each player can achieve different outcomes and awards at the end of the second portion of the community bingo game. It is contemplated that even though certain symbols (e.g., "7" in game card 140*a'*) are indicated as being selected at the beginning of the second portion of the community bingo game because of the optimal aspect having been applied, the same symbol (e.g., "7") can be randomly selected during the second portion of the community bingo game. For example, the "7" symbol can be randomly selected in the second portion such that the other game cards including the "7" symbol can be indicated as being selected for counting towards winning outcomes (e.g., the "7" symbol in the game card 140*b'*, etc.).

Figure 10B:
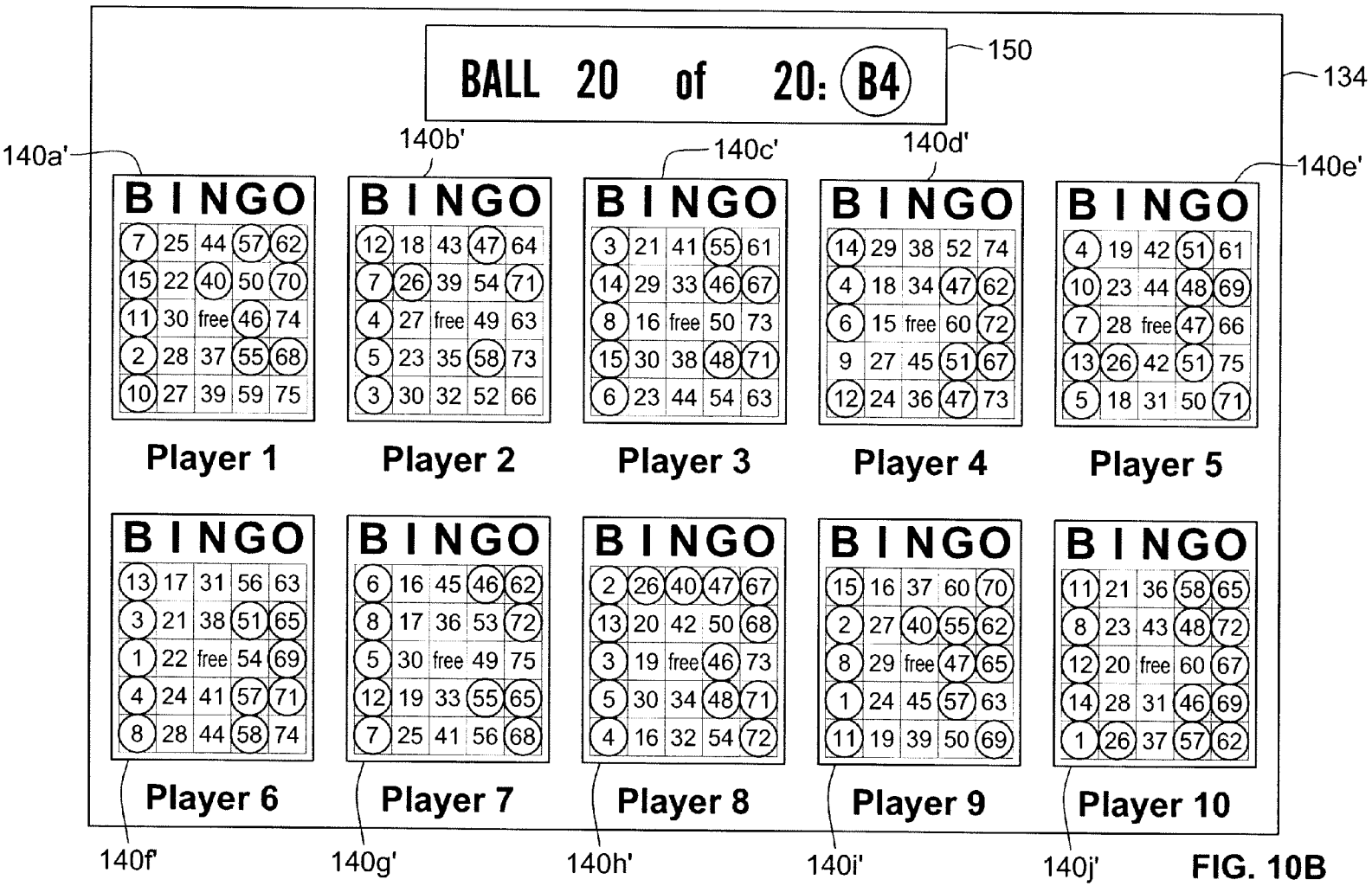

For example, as shown in screenshot 134 of FIG. 10B, after the twentieth play is conducted (e.g., the end of the community bonus game), each of the game cards 140*a'-j'* includes a different number of selected symbols 191 with at least partially different orientations. Thus, depending on which outcomes correspond to winning outcomes, each player can receive a different award. For example, if a game card having five selected symbols 191 in a row, either horizontally or vertically, is a winning outcome, then according to the illustrated example, players 1, 2, 3, 5, 6, 7, 8, 9, and 10 each have a winning outcome at the end of the community bingo game and player 4 does not have a winning outcome.

While the community gaming system 100 is shown as including four gaming terminals 110*a-d* and one overhead display 115, it is contemplated that the community gaming system 100 can include any number of gaming terminals 110, such as, for example, 2, 5, 10, 20, etc. and any number of overhead displays, such as, for example, 1, 2, 3, etc. It is further contemplated that such gaming terminals 110 and overhead displays 115 can be physically located in proximity to each other or dispersed across one or more gaming establishments. Also, the community gaming system 100 could be conducted online with players participating via personal computers, tablets, and other computing devices connected to the Internet.

It is contemplated that the community bonus game can include any number of free spins or plays including two or more total plays such that the first part includes one or more plays and the second part includes one or more plays, even though the community bonus game is described above as including ten free spins or plays where the first part includes the first five plays and the second part includes the second five plays. For example, the community bonus game can include four total plays wherein the first part includes three plays and the second part includes one play, such as illustrated in FIGS. 4A-6C.

While the persistent symbols 90*b* are described as persisting for all subsequent plays remaining in the first part of the community bonus game after initially appearing in a first part outcome, it is contemplated that the persistent symbols can persist for other amounts of plays and/or time. For example, the persistent symbols 90*b* can persist for 4 additional spins after initially appearing in an outcome. For another example, the persistent symbols 90*b* can persist for at least one additional spin after initially appearing in an outcome. For yet another example, the persistent symbols 90*b* can persist through a specific one of the free spins (e.g., the fifth free spin) of the ten free spins of the community bonus game.

It is contemplated that all outcomes displayed in the community bonus game initially include only an array of randomly selected basic symbols 90*a* and that any persistent symbols 90*b* appear only after a basic symbol 90*a* is altered into a persistent symbol 90*b*. The altering of the basic symbol into a persistent symbol is random and can not only change the basic symbol 90*a* into a persistent symbol 90*b*, but the altering can also change the function and/or the appearance of the basic symbol 90*a* in one or more particular symbol locations. For example, the basic symbol 90*a* can be altered such that its function changes to be a wild symbol and/or the appearance changes to indicate that the symbol is now wild. A basic "BAR" symbol can be modified to be a "STAR" to indicate that the symbol location that originally had the basic "BAR" symbol is now a wild "STAR" symbol. Once a basic symbol is altered, the altered symbol is maintained in the particular symbol location at least for any other outcomes in the current part of the community bonus game.

According to some alternative aspects, after the conclusion of the first part of the community bonus game, each player can be given an opportunity to select any one of the last outcomes in the first part of the community bonus game of any of the players to use in the second part of the community bonus game.

Even though the example described above in reference to FIG. 6B only includes one play in the second part of the community bonus game, it is contemplated that the second part of the community bonus game can include one or more plays.

While FIGS. 4A-4C are described as illustrating the first, the second, and the third outcomes of the first part of the community bonus game, it is contemplated that additional outcomes can be included in the first part of the community bonus game. For example, FIG. 4A can illustrate a second outcome, FIG. 4B can illustrate a fourth outcome, and FIG. 4C can illustrate a fifth outcome of the first part of the community bonus game. That is, any number of intervening outcomes can be included in the first part of the community bonus game so long as the persistent symbols 90*b* persist throughout the first part of the community bonus game.

According to some aspects of the present disclosure, in lieu of or in addition to any of the other aspects of the community bonus game described above, it is contemplated that the persistent symbols collected during the first part of the community bonus game are associated with a multiplier. Each collected persistent symbol during the first part of the community bonus game increases the player's multiplier by one. After the first part of the community bonus game, the community game system 100 determines which outcome is optimal based on which player accumulated the most persistent symbols. Any awards achieved by the players are multiplied by the multiplier associated with the determined optimal outcome. For example, as shown in FIG. 4C, player 3 accumulated five persistent symbols 90*b*, which is more than any other player. Thus, player 3's third outcome $\mathbf{120}c_3$ is the determined optimal outcome and any award achieved by the players as described above can be multiplied by a 5× multiplier.

Alternatively, instead of all players using a multiplier determined based only on the optimal outcome (e.g., player 3's third outcome $\mathbf{120}c_3$), the multipliers achieved during play of the first part of the community bonus game by all players can be added together and applied to each players' award, if any, achieved at the end of the second part of the community bonus game. For example, as shown in FIG. 4C, player 1's third outcome $\mathbf{120}a_3$ (i.e., final outcome in the first part) is associated with a multiplier of 2 as it includes two persistent symbols 90*b*. Similarly, player 2's third outcome $\mathbf{120}b_3$ is associated with a multiplier of 3, player 3's third outcome $\mathbf{120}c_3$ is associated with a multiplier of 5, and player 4's third outcome $\mathbf{120}d_3$ is associated with a multiplier of 2. Thus, according to such an alternative, the total multiplier achieved is 12× (2+3+5+2=12).

Even though the community bingo game is described above as including ten players, it is contemplated that the community bingo game can include any number of players, including human players and/or computer players (virtual players). For example, the community bingo game can have ten human players, five human players and five computer players, etc. It is also contemplated that the players can be at different locations, such as, for example, at one or more casinos, homes, hotels, etc., or any combination thereof.

While the community bingo game is described above as displaying all first game cards 140*a-j* to each player of the community bingo game, it is contemplated that during the first portion of the community bingo game only each player's game card is displayed to that respective player such that each player is not aware of the other player's outcomes during the first portion of the community bingo game.

While the game cards of the community bingo game are described as including basic symbols 190 including integer numbers between 1 and 75, inclusive, it is contemplated that any range of integer numbers of other types of symbols (e.g., shapes) can be used in lieu of the range 1-75.

While it is described above that selected symbols are altered to indicate that they were selected by circling the basic symbol 190 to result in a selected symbol 191, it is contemplated that the basic symbols 190 can be altered in a variety of other ways to indicate that the symbol was selected, such as, for example, obscuring, highlighting, or a combination thereof.

It is contemplated that during the conducting of the community bonus game and/or the community bingo game, one or more of the players will achieve a winning outcome that results in an award to that player. The award can be paid to the player directly after the winning outcome is achieved, after the first part/portion of the community bonus/bingo game, or after the second part/portion of the community bonus/bingo game in addition to any other awards achieved by the player during play of the community bonus/bingo game.

According to some aspects of the present disclosure, in lieu of or in addition to any of the other aspects of the community bingo game described above, in response to multiple game cards (during the first or second portion of the community bingo game) having a selected symbol in the same corresponding symbol position, a multiplier associated with the number of game cards having such selected symbol can be applied to any awards associated with those game cards. For example, if the symbol position in the first column, first position includes a selected symbol in 3 of 10 game cards, a multiplier of 3 can be applied to any awards associated with those three game cards. For another example, if the symbol position in the second column, third position includes a selected symbol in 7 of 10 game cards, a multiplier of 7 can be applied to any awards associated with those seven game cards.

It is contemplated that the community bingo game can be a standalone game or a bonus game of another bingo game or any other basic wagering game (e.g., slots game).

Each of these embodiments and obvious variations thereof is contemplated as falling within the spirit and scope of the claimed invention, which is set forth in the following claims.

What is claimed is:

1. A method of conducting a wagering game including a basic wagering game and a community bonus game, the method comprising:

receiving, via at least one input device, wagers from a plurality of players of the wagering game to play the basic wagering game;

triggering the community bonus game for at least a first player and a second player; and conducting the community bonus game, the conducting including:

(i) displaying, on at least one display, a first set of randomly determined outcomes for a first part of the community bonus game for each player, the first set of randomly determined outcomes including a last outcome for each player, the last outcome for at least the first player being different than the last outcome for the second player, the last outcome for at least one of the players including a persistent symbol that persists from the last outcome into at least one subsequent outcome for that player in a second part of the community bonus game;

(ii) determining, with at least one processor, which of the last outcomes is optimal for achieving a certain award within the community bonus game;

(iii) applying an optimal aspect of the optimal last outcome to at least the first player and the second player;

(iv) for the first player, continuing with the second part of the community bonus game with the optimal aspect applied such that an outcome of the second part of the community game for the first player is based on a combination of the optimal aspect and a first newly added aspect from the second part of the community bonus game; and (v) for the second player, continuing with the second part of the community bonus game with the optimal aspect applied such that an outcome of the second part of the community game for the second player is based on a combination of the optimal aspect and a second newly added aspect from the second part of the community bonus game.

2. The method of claim 1, wherein the persistent symbol is a wild symbol.

3. The method of claim 1, wherein the first newly added aspect is the same as the second newly added aspect.

4. The method of claim 1, wherein the first newly added aspect is different from the second newly added aspect.

5. The method of claim 1, wherein the community bonus game is a slots game or a bingo game.

6. The method of claim 1, wherein the basic wagering game is a slots game and the community bonus game includes free spins of the slots game.

7. The method of claim 1, wherein the optimal last outcome is the last outcome that has the highest probability of achieving the highest payout within the community bonus game.

8. A method of conducting a wagering game including a community bonus game, comprising:

receiving, via one or more input devices, wagers from players of the wagering game;

triggering the community bonus game;

displaying, on at least one display, a first bonus game outcome for each player, the first bonus game outcome being different for at least two of the players, the first bonus game outcome for at least one of the players including a persistent symbol that persists from the first bonus game outcome into at least one subsequent bonus game outcome for that player in a continued portion of the community bonus game;

determining, via at least one processor, which of the first bonus game outcomes for the players is optimal for achieving the highest payout during the continued portion of the community bonus game; and continuing the continued portion of the community bonus game so as to achieve a second bonus game outcome for each player, the second bonus game outcome for each player being at least partially based on the determined optimal first bonus game outcome so as to provide each player with an equal opportunity to achieve the highest payout during the continued portion of the community bonus game.

9. The method of claim 8, wherein the continuing the continued portion of the community bonus game includes displaying, on the at least one display, the second bonus game outcomes for the players.

10. The method of claim 9, wherein the displayed second bonus game outcomes are the same for each of the players.

11. The method of claim 9, wherein the displayed second bonus game outcomes are different for each of the players.

12. A method of conducting a community game for at least a first player and a second player, the method comprising:

displaying, via one or more display devices, a first outcome of the community game for each player, the outcomes being indicated by a plurality of symbols on the one or more display devices;

determining, via at least one processor, which of the first outcomes has optimal symbols from the plurality of symbols for achieving the highest payout during continued play of the community game; and displaying, via the one or more display devices, a second outcome for each player, the second outcomes being at least partially based on the optimal symbols from the first outcome determined to have the optimal symbols, the second outcome of the first player being different from the second outcome of the second player, the optimal symbols included in the first outcome persisting such that the optimal symbols are included in each of the second outcomes.

13. The method of claim 12, wherein the one or more display devices includes at least one display device for each player.

14. A method of conducting a community game for a plurality of players, the method comprising:

displaying, via one or more display devices, a first set of outcomes for a first part of the community game for at least a first player and a second player, the first set of outcomes resulting in a first-part-final outcome for each player, at least one of the outcomes includes a persistent symbol that persists during the first part of the community game such that the first-part-final outcome for one of the players includes at least one persistent symbol appearing in a previous outcome in the first set of outcomes, the first-part-final outcome for at least the first player being different that the first-part-final outcome for the second player;

determining, via at least one processor, which of the first-part-final outcomes is optimal for achieving the highest payout within the community game; and displaying, via the one or more display devices, a second set of outcomes for at least the first player and the second player, the second set of outcomes being based on a combination of the determined optimal first-part-final outcome and a newly added aspect of a second part of the community game.

15. The method of claim 14, wherein the persistent symbol is a wild symbol.

16. The method of claim 14, wherein each of the first-part-final outcomes includes at least one persistent symbol.

17. The method of claim 14, wherein each of the first-part-final outcomes includes a different number of persistent symbols.

18. The method of claim 14, wherein the second set of outcomes for the first player is the same as the second set of outcomes for the second player.

19. The method of claim 14, wherein at least the second set of outcomes for the first player is different from the second set of outcomes for the second player.

20. The method of claim 14, wherein the first and second set of outcomes are indicated by displaying a plurality of symbols on the one or more display devices.

21. A method of conducting a community game for a plurality of players, the method comprising:

displaying, via one or more display devices, a first set of outcomes for at least a first player and a second player, each of the outcomes including a plurality of symbol locations having respective symbols that indicate a randomly selected outcome of the community game;

altering at least one of the symbols in at least one of the outcomes for the first player to change the function of the symbol in a particular one of the plurality of symbol locations;

maintaining the altered symbol in the particular symbol location in subsequent outcomes in the first set of outcomes for the first player, the first set of outcomes resulting in an intermediate outcome for each player, the intermediate outcome of the first player being different from the intermediate outcome for the second player;

determining, via at least one processor, which of the intermediate outcomes for the players is optimal for achieving a certain award during a continued portion of the community game; and displaying, via the one or more display devices, a second set of outcomes for each player in the continued portion of the community game, the second set of outcomes for each player being at least partially based on the determined optimal intermediate outcome so as to provide each player with an equal opportunity to achieve the certain award during the continued portion of the community game.

22. The method of claim 21, wherein the altering includes altering the appearance of the symbol to indicate that the symbol is now a wild symbol.

23. A method of conducting a community bingo game for a plurality of players, the method comprising:

displaying during a first portion of the community bingo game, via one or more display devices, a first game card for at least a first player and a second player, each first game card including a plurality of symbol locations having respective symbols such that the plurality of symbol locations form an array of symbols, the array of symbols being at least partially different for each first game card;

during the first portion, randomly selecting, using one or more processors, a portion of the symbols included in the array of symbols on at least one of the first game cards;

altering, via the one or more display devices, the randomly selected symbols on each of the first game cards including selected symbols to indicate that the symbols were randomly selected;

determining at the end of the first portion, using the one or more processors, which of the first game cards for the players is optimal for achieving the highest payout during a continued portion of the community bingo game; and continuing the continued portion of the community bingo game including displaying, via the one or more display devices, a second game card for each one of the players, the second game card for each player being at least partially based on the determined optimal first game card, the altered randomly selected symbols on the first game card determined to be optimal being persistent symbols that are included in each of the second game cards.

24. The method of claim 23, wherein the second game card of each player is at least partially based on the determined optimal first game card in that symbols in symbol positions on the second game card for each player that correspond to symbol positions in the determined optimal first game card that were selected during the first portion of the community bingo game are altered in the continued portion of the community bingo game to indicate that the symbols in such symbol positions on the second game card for each player are selected for the continued portion of the community bingo game.

25. The method of claim 23, further comprising during the continued portion, randomly selecting, using the one or more processors, a portion of the symbols included on at least one of the second game cards and altering, via the one or more display devices, the randomly selected symbols on each of the second game cards including selected symbols to indicate that the symbols were randomly selected.

26. The method of claim 25, prior to the randomly selecting and altering of the selected symbols on the second game cards, the method further comprising altering symbols in symbol positions on the second game card that correspond with symbol positions in the determined optimal first game card that were selected during the first portion of the community bingo game.

27. The method of claim 23, wherein the altering includes altering the symbol location including the randomly selected symbols such that the randomly selected symbols are obscured, circled, highlighted, or a combination thereof.

28. The method of claim 23, wherein the second game card is the same for all of the players.

* * * * *